US006309055B1

(12) United States Patent
Sakai et al.

(10) Patent No.: US 6,309,055 B1
(45) **Date of Patent: *Oct. 30, 2001**

(54) INK JET PRINTING HEAD HAVING A REDUCED WIDTH PIEZOELECTRIC ACTIVATING PORTION

(75) Inventors: Shinri Sakai; Toyohiko Mitsuzawa, both of Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/113,562

(22) Filed: Jul. 10, 1998

(30) Foreign Application Priority Data

Jul. 10, 1997 (JP) ..... 9-185561

(51) Int. Cl.[7] ..... B41J 2/045

(52) U.S. Cl. ..... 347/70; 310/328; 310/331; 310/365

(58) Field of Search ..... 347/70, 71, 68, 347/72; 310/328, 333, 330, 331, 364, 365

(56) References Cited

U.S. PATENT DOCUMENTS

| | | | | |
|---|---|---|---|---|
| 5,510,819 | * | 4/1996 | Fujimoto et al. | 347/70 |
| 5,637,126 | | 6/1997 | Ema et al. | 65/31 |
| 6,089,701 | * | 7/2000 | Hashizume et al. | 347/70 |

FOREIGN PATENT DOCUMENTS

| | | | |
|---|---|---|---|
| 5-286131 | 11/1993 | (JP) | B41J/2/045 |

OTHER PUBLICATIONS

Patent Abstracts of Japan vol. 017, No. 455 (M–1466) Aug. 20, 1993 & JP 05 104715 A (Sharp Corp) Apr. 27, 1993 *Abstract.

Patent Abstracts of Japan vol. 017, No. 201 (M–1399) Apr. 20, 1993 & JP 04 345854 A (Seiko Epson Corp) Dec. 1, 1992 *Abstract.

Patent Abstracts of Japan vol. 009, No. 252 (M–420) Oct. 9, 1985 & JP 60 104337 A (Fujitsu KK) Jun. 8, 1985 * Abstract.

Patent Abstracts of Japan vol. 1996, No. 609, Sep. 30, 1996 & JP 08 118618A (Mita Ind Co Ltd) May 14, 1996 *Abstract.

Patent Abstracts of Japan vol. 007,No. 230 (M–249) Oct. 12, 1983 & JP 58 122878 A (Ricoh KK) Jul. 21, 1993 *Abstract.

* cited by examiner

*Primary Examiner*—Benjamin R. Fuller
*Assistant Examiner*—C Dickens
(74) *Attorney, Agent, or Firm*—Sughrue, Mion, Zinn, Macpeak & Seas, PLLC

(57) ABSTRACT

An ink jet printing head incorporating an elastic plate forming a pressure generating chamber allowed to communicate with nozzle openings and composed of an elastic film and a lower electrode film, a piezoelectric film and an upper electrode film formed in a region opposite to the pressure generating chamber, the ink jet printing head having a structure that an insulating layer having a contact holes which are windows for establishing the connection with a conductive pattern for applying voltage to the upper electrode is formed on the upper surface of the upper electrode film. Moreover, the portions of the elastic plate opposite to the pressure generating chambers and corresponding to the contact holes cannot easily be deformed when voltage is applied to the piezoelectric element as compared with the other portions.

12 Claims, 12 Drawing Sheets

B-B′ SECTION

C-C′ SECTION

INK JET PRINTING HEAD HAVING A REDUCED WIDTH PIEZOELECTRIC ACTIVATING PORTION

BACKGROUND OF THE INVENTION

1. Field of the Invention

The present invention relates to an ink jet printing head having a structure that the portion of a pressure generating chamber communicating with a nozzle opening for ejecting ink droplets is formed by an elastic plate and a piezoelectric element is formed on the surface of the elastic plate, so that ink droplets eject by the displacement of the piezoelectric element and elastic plate.

2. Related Art

There has been known a conventional ink jet printing head having pressure generating chambers communicating with nozzle openings for ejecting ink droplets and structured such that a portion of the pressure generating chambers is formed by an elastic plate. The elastic plate is deformed by a piezoelectric element to apply pressure to ink in the pressure generating chambers so as to eject ink droplets through the nozzle openings. There are two different types of ink jet printing heads practical used, one structure comprises a piezoelectric element having a vertical oscillation mode in which the piezoelectric actuator is expanded/contracted in the axial direction thereof; and the other structure comprises a piezoelectric actuator having a deflection oscillation mode.

The former structure is able to vary the capacity of the pressure generating chamber when the end surface of the piezoelectric actuator is brought into contact with the elastic plate. Thus, a head adapted to a high density printing operation can be manufactured. However, a difficult process is required in which the piezoelectric actuator is sectioned into comb shape to coincide with the arrangement pitch of the nozzle openings. Moreover, a process is required to locate the sectioned piezoelectric actuator to be located and secured in the pressure generating chamber. Thus, the former structure has a problem in that the manufacturing process is too complicated.

On the other hand, the latter structure is able to provide the piezoelectric element for the elastic plate by a relatively simple process in which a green sheet of the piezoelectric material is applied to be adaptable to the shape of the pressure generating chamber and then the green sheet is baked. Since the deflection oscillation is used, a somewhat large area is required. Thus, there arises a problem in that dense arrangement cannot easily be realized.

To overcome the problem experienced with the latter printing head, a structure has been disclosed in Unexamined Japanese Patent Application (OPI) No. 5-286131. In this case, a uniform piezoelectric material layer is formed on the overall surface of the elastic plate by a film forming technology. Then, the piezoelectric material layer is cut into a shape adaptable to the pressure generating chamber by a lithographic method. Thus, the piezoelectric element is formed independently for each of the pressure generating chambers.

As a result, the process for applying the piezoelectric element to the elastic plate can be omitted. Thus, the piezoelectric actuator may be provided by the lithographic method which is a precise and simple method. Moreover, advantage is realized in that the thickness of the piezoelectric actuator is reduced and thus high speed operation is permitted. In this case, at least only the upper electrode is provided for each of the pressure generating chambers while the piezoelectric material layer is as it is provided for the overall surface of the elastic plate. Thus, the piezoelectric actuator corresponding to the pressure generating chambers can be operated.

The printing head of the type comprising the piezoelectric actuators having the deflection mode is arranged such that the piezoelectric actuators corresponding to the pressure generating chambers are covered with an insulating layer. Moreover, windows (hereinafter called "contact holes") are provided for the insulating layer so as to form connection portions with a conductive pattern for supplying voltage to each of the piezoelectric actuator such that the windows are formed to correspond to the pressure generating chambers. Moreover, connecting portions between the piezoelectric actuators and the conductive pattern are formed in the contact hole.

However, the contact hole portion in which the connection portion between the piezoelectric actuators corresponding to the pressure generating chambers and the conductive pattern is formed easily encounters generation of great stress because of the operation of the piezoelectric actuators. Thus, there arises a problem in that generation of cracks and occurrence of breakage cannot be prevented.

Since the connection portion with the conductive pattern is connected to the contact hole portion, displacement caused because of application of voltage is relatively restrained. However, the compliance is not small as compared with that of the other portions. Therefore, there arises a problem in that the eject speed is reduced and the operating voltage is raised.

The foregoing problem becomes critical when the piezoelectric material layer is formed by the film forming technology. Since the piezoelectric material formed by the film forming technology is very thin, only a poor rigidity can be realized as compared with the structure formed by applying the piezoelectric actuator.

SUMMARY OF THE INVENTION

In view of the foregoing, an object of the present invention is to provide an ink jet printing head which is capable of preventing generation of cracks and occurrence of breakage because of concentration of stress into the contact portion and preventing deterioration in the efficiency of the displacement in the contact portion.

To solve the above-mentioned problems, according to a first aspect of the present invention, there is provided an ink jet printing head having a piezoelectric vibrator having a piezoelectric actuator including: an elastic plate which constitutes at least a portion of a pressure generating chamber communicating with nozzle openings; a piezoelectric element formed on the surface of said elastic plate; and a piezoelectric activating portion formed in a region opposite to said pressure generating chamber, wherein the width of said piezoelectric activating portion in each region opposite to said pressure generating chamber is smaller than the width of said pressure generating chamber, a contact portion connecting to a lead electrode for applying voltage to an upper electrode of said piezoelectric element is formed on the upper surface of said upper electrode, and deformation of the portion of said elastic plate, which is opposite to said pressure generating chamber, corresponding to said contact portion is made to be difficult when voltage is applied to said piezoelectric element as compared with the other portions.

Since the first aspect of the invention has the structure that the displacement of the elastic plates in the portion corresponding to the contact portion is restrained as compared with those of the other portions, stress which is imposed on the piezoelectric layer corresponding to the contact portion can be reduced. Thus, breakage can be prevented.

According to a second aspect of the present invention, there is provided an ink jet printing head according to the first aspect, wherein an insulating layer is formed on the upper surface of the upper electrode, and the insulating layer has a contact hole portion which is a window for forming the contact portion between the lead electrode and the upper electrode.

Since the second aspect has the structure that the displacement of the piezoelectric actuators in the portion corresponding to the contact portion is restrained as compared with those of the other portions, stress which is imposed on the piezoelectric activating portion corresponding to the contact portion can be reduced. Thus, breakage can be prevented.

According to a third aspect of the present invention, there is provided an ink jet printing head according to the first or second aspect, wherein the width of the portion of the piezoelectric activating portion, which corresponds to the pressure generating chamber, corresponding to the contact portion is smaller than the width of the other portions.

Since the third aspect is structured such that the width of the piezoelectric activating portion corresponding to the contact hole portion is small, displacement occurring because of the operation of the contact hole portion is restrained as compared with the other portions. Thus, generation of stress can be prevented and breakage and the like can be prevented.

According to a fourth aspect of the present invention, there is provided an ink jet printing head according to any one of the first to third aspects, wherein the width of a portion of the pressure generating chamber corresponding to the contact portion is smaller than the width of the other portions.

Since the fourth aspect is structured such that the width of the portion of the pressure generating chamber corresponding to the contact hole portion is small, displacement occurring because of the operation of the contact hole portion is restrained as compared with those of the other portions. As a result, generation of stress can be prevented and breakage can be prevented. Since compliance of the contact hole portion can be reduced, the overall eject speed can be raised.

According to a fifth aspect of the present invention, there is provided an ink jet printing head according to any one of the first to fourth aspects, wherein the thickness of the elastic plate, which covers the pressure generating chamber, corresponding to the contact portion is larger than the thickness of the portion corresponding to the other portion.

Since the fifth aspect has the structure that the thickness of the portions of the elastic plate and the lower electrode corresponding to the contact hole portion are larger than those of the other portions, displacement occurring because of the operation of the contact hole portion is restrained as compared with the other portions. As a result, generation of stress can be restrained and breakage or the like can be prevented.

According to a sixth aspect of the present invention, there is provided an ink jet printing head according to any one of the first to fourth aspects, wherein the thickness of the portion of the elastic plate, which covers the pressure generating chamber, adjacent to an outer wall of either of the pressure generating chambers is larger in the portion corresponding to the contact hole portion than in the portions except for the portion corresponding to the contact hole portion.

Since the sixth aspect is structured such that the thickness of the elastic plate and the lower electrode which are displaced portion corresponding to the contact hole portion are larger than those of the other portions, displacement occurring because of the operation of the contact hole portion can be restrained as compared with the other portions. As a result, generation of stress can be restrained and breakage or the like can be prevented.

According to a seventh aspect of the present invention, there is provided an ink jet printing head according to any one the first to sixth aspects, wherein the pressure generating chamber is formed on a single-crystal silicon substrate by anisotropic etching, and each layer of the piezoelectric vibrator is formed by a film forming process and a lithography process.

The seventh aspect is able to manufacture ink jet printing heads each having dense nozzle openings in a large quantity and relatively easily.

The eighth aspect is able to manufacture ink jet printing heads in which a portion corresponding to contact hole is relatively, hardly deformed.

PREFERRED EMBODIMENT OF THE INVENTION

An embodiment of the present invention will now be described.

1. First Embodiment

Figure 1:
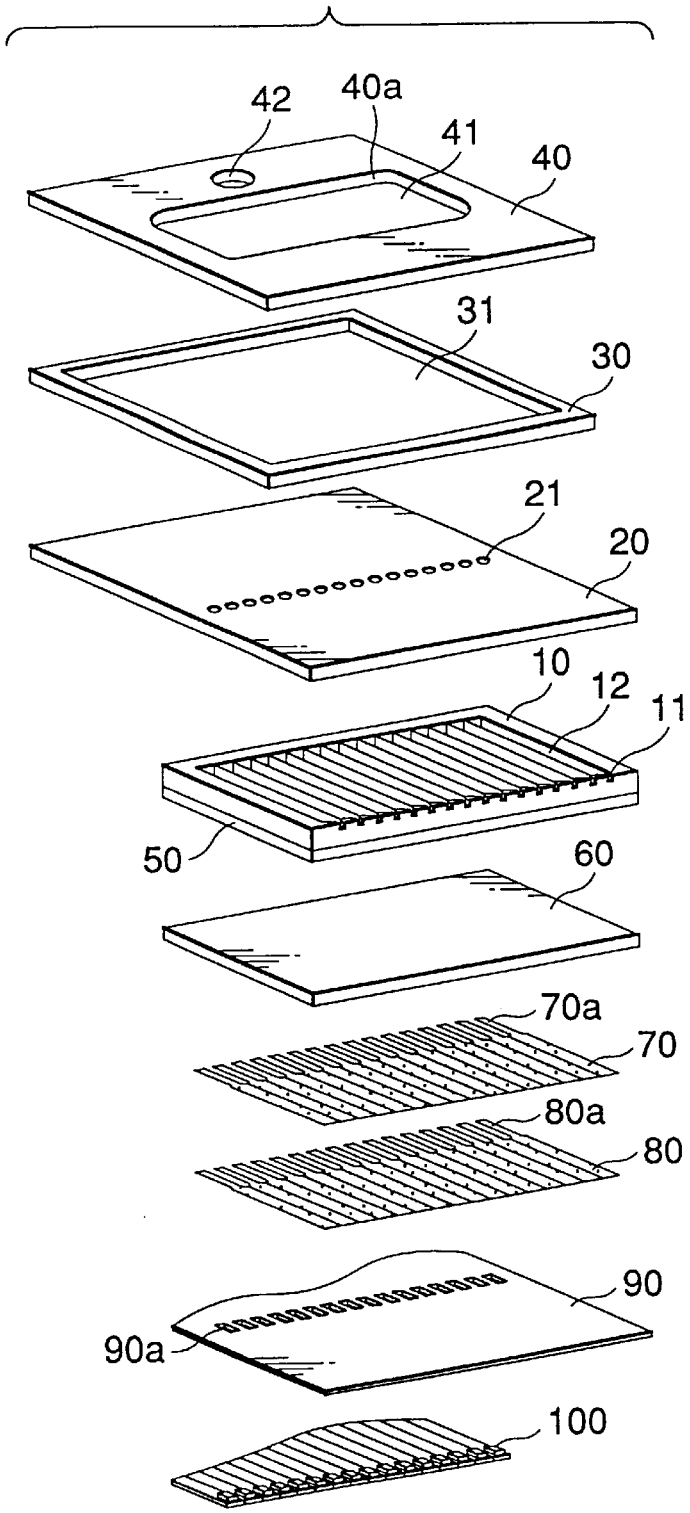
FIG. 1 is an exploded perspective view showing an ink jet printing head according to an embodiment of the present invention.
Figure 2A:
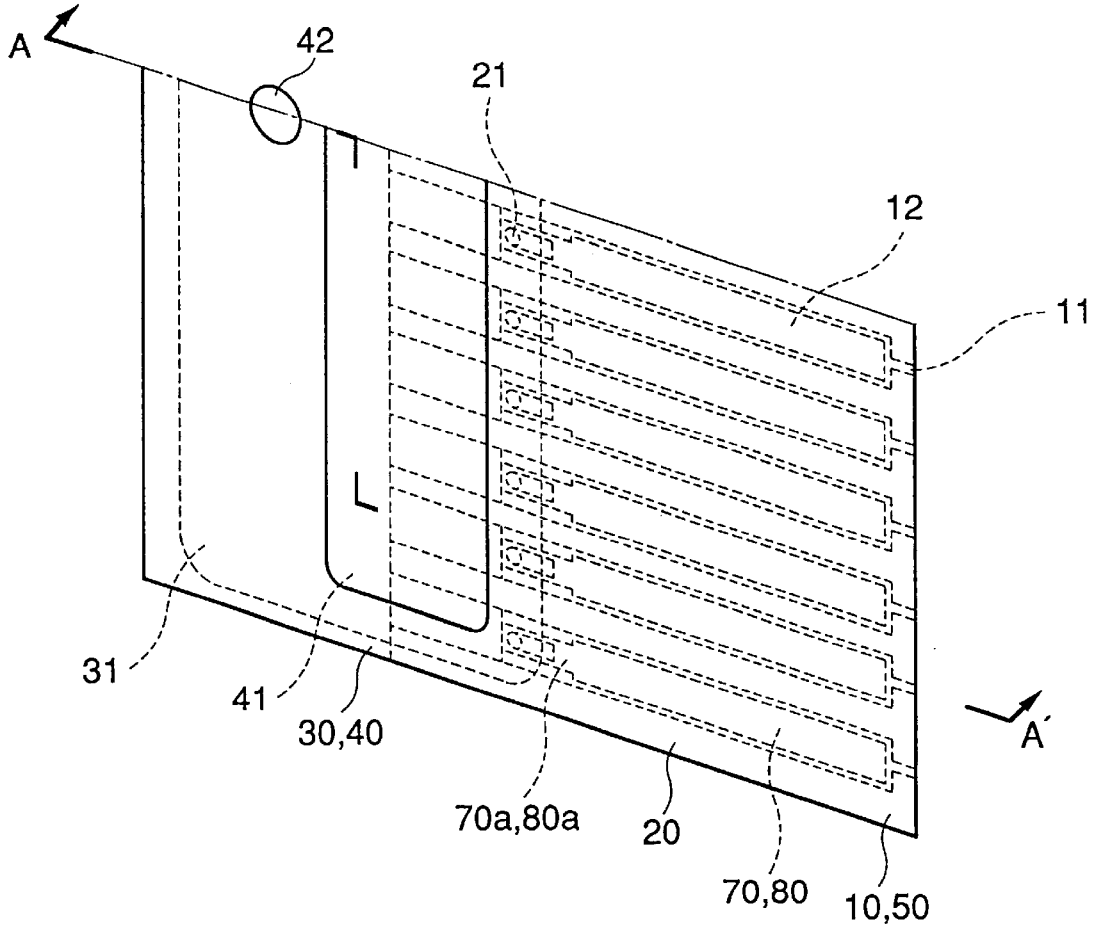
FIGS. 2A and 2B are diagrams showing the ink jet printing head according to the first embodiment of the present invention and includes a plan view and a cross sectional view of FIG. 1.
Figure 2B:
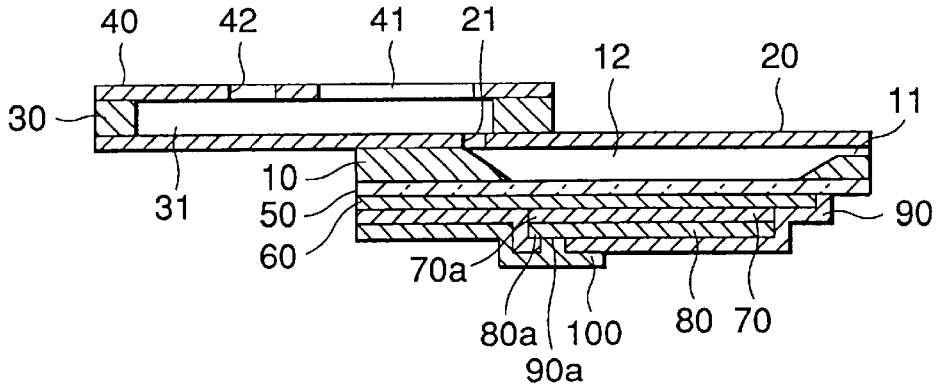

FIG. 1 is a perspective view showing an assembled ink jet printing head according to an embodiment of the present invention. FIGS. 2A and 2B are a diagram showing the cross sectional structure of one of the pressure generating chambers in the lengthwise direction.

As shown in the drawings, a fluid-passage-forming substrate 10 is made of single-crystal silicon substrate having a face azimuth of (110). The fluid-passage-forming substrate 10 is usually made of a substrate having a thickness of about 150 μm to 300 μm, preferably about 180 μm to about 280 μm, more preferably about 220 μm. The reason for this lies in that the foregoing thickness is able to raise the density of arrangement while the rigidity of insulating walls among adjacent pressure generating chambers is maintained.

One of the surfaces of the fluid-passage-forming substrate 10 is formed into an opened surface, while another surface has an elastic film 50 made of silicon dioxide previously formed by thermal oxidation and having a thickness of 1 μm to 2 μm.

On the other hand, the opened surface of the fluid-passage-forming substrate 10 has nozzle openings 11 and pressure generating chambers 12 formed by anisotropically etching the single-crystal silicon substrate.

The anisotropic etching is performed such that the single-crystal silicon substrate is immersed in alkali solution of, for example, KOH. Thus, the single-crystal silicon substrate is gradually eroded so that first faces (111) perpendicular to faces (110) and second faces (111) making an angle of about 35 degrees from the faces (110) appear. The anisotropic etching is performed by using a characteristic that the etching rate enabled for the faces (111) is about 1/180 of the etching rate enabled for the faces (110). The anisotropic etching enables a precise machining to be performed by mainly performing vertical machining of parallelograms each of which is formed by two first faces (111) and two second diagonal faces (111). Thus, the pressure generating chambers 12 can densely be arranged.

In this embodiment, the longer side of each of the pressure generating chambers 12 is formed by the first faces (111) and the shorter side of the same is formed by the second faces (111). The pressure generating chambers 12 are formed by etching performed to substantially penetrate the fluid-passage-forming substrate 10 to reach the elastic film 50. The elastic film 50 is eroded in the alkali solution in a very small quantity, the alkali solution being used to etch the single-crystal silicon substrate.

On the other hand, each of the nozzle openings 11 allowed to communicate with ends of the pressure generating chambers 12 is formed into a shape having a width and a depth smaller than those of each of the pressure generating chambers 12. That is, the nozzle openings 11 are formed by etching the single-crystal silicon substrate to an intermediate position of the thickness of the single-crystal silicon substrate (by half etching). Note that half etching is performed by adjusting etching duration.

The size of each of the pressure generating chambers 12 for applying pressure for ejecting ink droplets and that of each of the nozzle openings 11 for ejecting ink droplets are optimized in accordance with the quantity of ink droplets to be ejected, the eject speed and the eject frequency. When, for example, 360 ink droplets per inch are recorded, each of the nozzle openings 11 must precisely be formed to have a groove width of several tens of μm.

Each of the pressure generating chambers 12 and a common ink chamber 31 to be described later are allowed to communicate with each other through ink supply communication openings 21 formed at positions corresponding to the ends of the pressure generating chambers 12 of a sealing plate 20 to be described later. Thus, ink is supplied from the common ink chamber 31 through the ink supply communication openings 21 so as to be distributed to the pressure generating chambers 12.

Figure 3A:
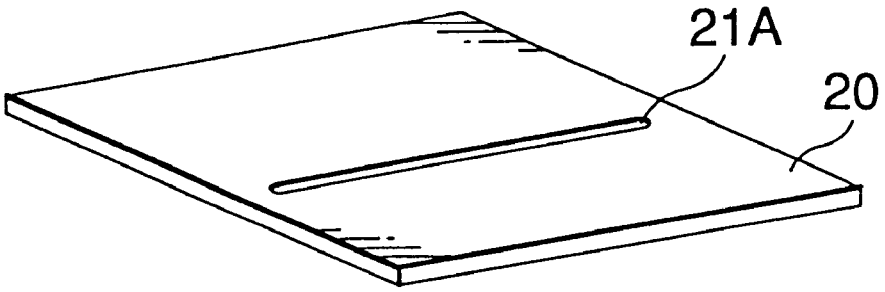
FIGS. 3A and 3B are diagrams showing a modification of the sealing plate shown in FIG. 1.
Figure 3B:
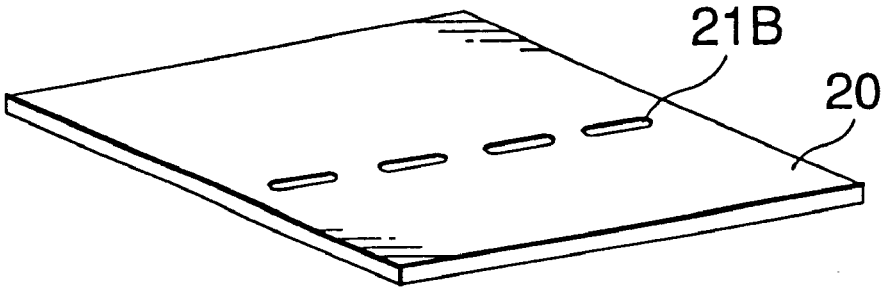

The sealing plate 20 is made of glass ceramics having the ink supply communication openings 21 corresponding to the pressure generating chambers 12, a thickness of, for example, about 0.1 mm to 1 mm and a linear expansion coefficient of, for example, 2.5 [$\times 10^{-6}$/° C.] to 4.5 [$\times 10^{-6}$ /° C.] when the temperature is 300° C. or lower. Note that the ink supply communication openings 21 may be one slit opening 21A traversing a position adjacent to an end of the ink supply portion of each of the pressure generating chambers 12 or a plurality of slit openings 21B, as shown in FIGS. 3A and 3B. One of the surfaces of the sealing plate 20 covers the overall surface of the fluid-passage-forming substrate 10 so as to also serve to protect the single-crystal silicon substrate from an impact or external force. Moreover, another surface of the sealing plate 20 forms a wall of the common ink chamber 31.

A common-ink-chamber forming substrate 30 forms the wall of the common ink chamber 31 and manufactured by punching stainless steel having an appropriate thickness corresponding to the number of nozzle openings and the ink-droplet eject frequency. In this embodiment, the thickness of the common-ink-chamber forming substrate 30 is 0.2 mm.

Ink-chamber side plates 40 are made of stainless steel substrates so that the surface of each of the ink-chamber side plates 40 forms the wall of the common ink chamber 31. The ink-chamber side plate 40 has a thin wall 41 formed by half-etching a portion of another surface to form a recess 40a. Moreover an ink introducing opening 42 which is supplied with ink from outside is provided for the ink-chamber side plate 40. The thin wall 41 absorbs the pressure which is generated when ink droplets are ejected and applied in a direction opposite to the nozzle openings 11. Thus, unnecessary application of positive or negative pressure to the other pressure generating chambers 12 through the common ink chamber 31 is prevented. In this embodiment, rigidity required to establish the connection between the ink introducing opening 42 and an external ink supply means is considered. Thus, the thickness of the ink-chamber side plate 40 is made to be 0.2 mm and a portion of the ink-chamber side plate 40 is made to be the thin wall 41 having a thickness of 0.02 mm. To omit the process for forming the thin wall 41 by half etching, the thickness of the ink-chamber side plate 40 may initially be made to be 0.02 mm.

On the other hand, a piezoelectric element which includes a lower electrode film 60 having a thickness of, for example, about 0.5 μm, and a piezoelectric film 70 having a thickness of, for example, about 1 μm and an upper electrode film 80 having a thickness of, for example, about 0.1 μm are stacked on the elastic film 50 in a portion opposite to the opening formed in the fluid-passage-forming substrate 10 so that a piezoelectric actuator is constituted. As described above, the piezoelectric elements are disposed to the regions of the elastic film 50 opposite to the pressure generating chambers 12 such that the piezoelectric element is independently disposed for each of the pressure generating chambers 12. In this embodiment, the lower electrode film 60 is made to be a common electrode of the piezoelectric element. Moreover, the upper electrode film 80 is made to be an individual electrode for the piezoelectric elements. Although this embodiment has the structure that the piezoelectric films 70 are provided individually for the pressure generating chambers 12. In this embodiment, the lower electrode film 60 is not limited to the single plate-like member, but may be modified to be a comb-like member which is provided with one vertical bridge and several sections extending horizontally to correspond to the respective pressure generating chamber. Another structure may be employed in which a piezoelectric film is provided for the overall surface and the upper electrode film 80 is individually provided for each of the pressure generating chambers 12. In either case, a piezoelectric activating portion is constituted by the lower electrode film, piezoelectric layer and the upper electrode film which is deformed by the voltage applied, and the piezoelectric activating portion is provided for each of the pressure generating chambers 12.

In this embodiment, portions of the piezoelectric film 70 and the upper electrode film 80 corresponding to contact holes 90*a* of an insulating layer 90 to be described later are formed into small-width portions 70*a* and small-width portions 80*a* each having a width smaller than that of the other portions of the piezoelectric film and the upper electrode film.

The insulating layer 90 having an electrical insulating characteristic is formed to cover at least the outer periphery of the upper surface of each of the upper electrode films 80 and the side surfaces of the piezoelectric film 70. It is preferable that the insulating layer 90 is made of a material which can be formed by a film forming method or shaped by etching, for example, silicon oxide, silicon nitride or an organic material, preferably photosensitive polyimide having low rigidity and excellent electrical insulating characteristic.

A contact hole 90*a* for allowing a portion of the small-width portion 80*a* of the upper electrode film 80 which is connected to a conductive pattern 100 described later to be exposed is formed in a portion of the portion of the insulating layer 90 for covering the upper surface of the portion corresponding to the small-width portion 80*a* of the upper electrode film 80. The conductive pattern 100 is formed which has an end connected to each of the upper electrode films 80 through the contact hole 90*a* and another end extending to the connection terminal portion. The conductive pattern 100 is formed to have a minimum width which enables a drive signal to reliably be supplied to the upper electrode film 80.

A process for forming the piezoelectric film 70 and the like on the fluid-passage-forming substrate 10 made of the single-crystal silicon substrate will now be described with reference to FIGS. 4 and 4A–4E and 5A–5C.

Figure 4A:
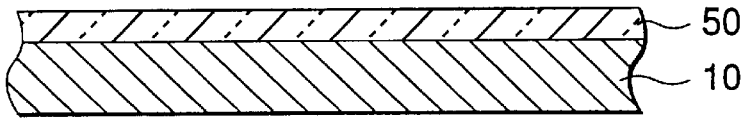
FIGS. 4A–4E are diagrams showing a process for manufacturing thin films according to the first embodiment of the present invention.

As shown in FIG. 4A, wafer of the single-crystal silicon substrate from which the fluid-passage-forming substrate 10 is formed is thermally oxidized in a diffusion furnace, the internal temperature of which is made to be about 1100° C. so that the elastic film 50 made of silicon dioxide is formed.

Figure 4B:
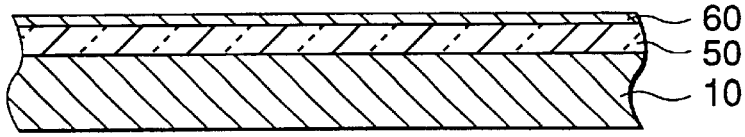

Then, as shown in FIG. 4B, the lower electrode film 60 is formed by sputtering. As a material of the lower electrode film 60, it is preferable that Pt or the like is employed. The reason for this lies in that a piezoelectric film 70 to be described later and which is formed by sputtering or sol-gel method must be baked and crystallized at temperatures of about 600° C. to about 1000° C. in the atmosphere or in an atmosphere of oxygen after the piezoelectric film 70 has been formed. That is, the material of the lower electrode film 60 must maintain conductivity even in the above-mentioned high temperature and oxygen atmosphere. If PZT is employed as the material of the piezoelectric film 70, it is preferable that change in the conductivity which occurs because of diffusion of PbO is restrained. Therefore, Pt is a preferred material.

Figure 4C:
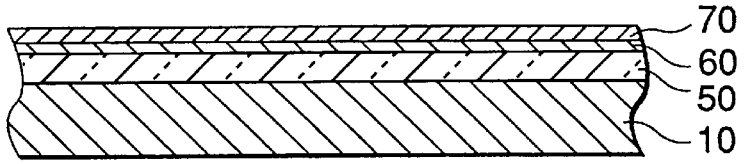

Then, as shown in FIG. 4C, the piezoelectric film 70 is formed. Although the piezoelectric film 70 can be formed by sputtering, this embodiment has a structure that a so-called sol-gel method is employed. That is, so-called sol prepared by dissolving a metal organic material in a solvent is applied and then dried to transform the sol into gel. Then, the gel is baked at high temperatures so that the piezoelectric film 70 made of the metal oxide is obtained. As a material of the piezoelectric film 70, it is preferable that lead zirconate titanate (PZT) is adapted to the ink jet printing head.

Figure 4D:
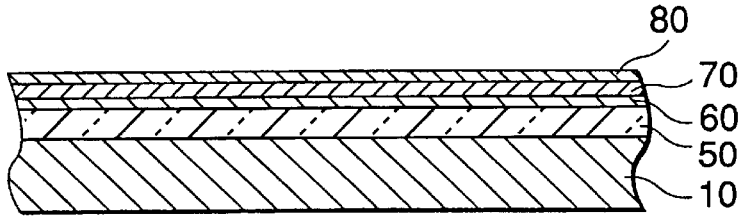

Then, as shown in FIG. 4D, the upper electrode film 80 is formed. The upper electrode film 80 must be made of a material having excellent conductivity. Thus, any one of a multiplicity of metal materials, such as Al, Au, Ni and Pt or a conductive oxide may be employed. In this embodiment, a Pt film is formed by sputtering.

Figure 4E:
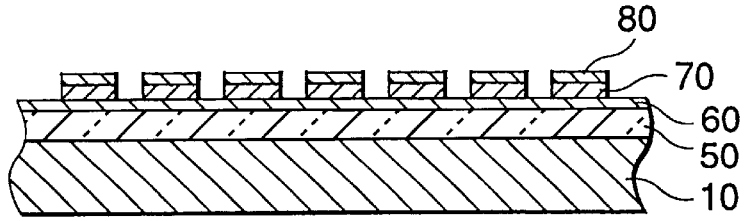

Then, as shown in FIG. 4E, the upper electrode film 80 and the piezoelectric film 70 are patterned in such a manner that the piezoelectric actuator is provided for each of the pressure generating chambers 12. FIG. 4E shows a process in which the piezoelectric film 70 is patterned with the same pattern as that of the upper electrode film 80. As described above, patterning of the piezoelectric film 70 may be omitted. The reason for this lies in that when voltage is applied such that the pattern of the upper electrode film 80 is used as an individual electrode, the electric field is applied to only each of the upper electrode films 80 and the lower electrode film 60 which is the common electrode. No influence is exerted on the other portions. However, high voltage must be applied to obtain the same excluded volume. Therefore, it is preferable that also the piezoelectric film 70 is patterned. Then, the lower electrode film 60 is patterned so that unnecessary portions are removed.

Figure 5A:
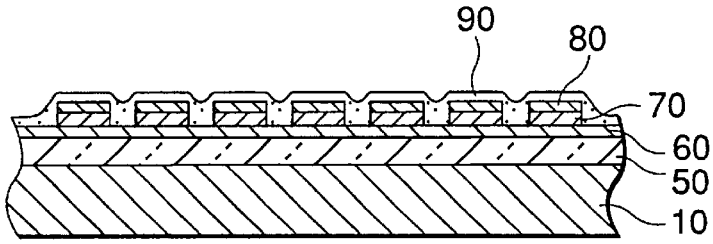
FIGS. 5A–5C are diagrams showing a process for manufacturing thin films according to the first embodiment of the present invention.

Then, as shown in FIG. 5A, the insulating layer 90 is formed to cover the outer periphery of the upper electrode film 80 and the side surface of the piezoelectric film 70. A preferred material of the insulating layer 90 is as described above. In this embodiment, a negative-type photosensitive polyimide is employed.

Figure 5B:
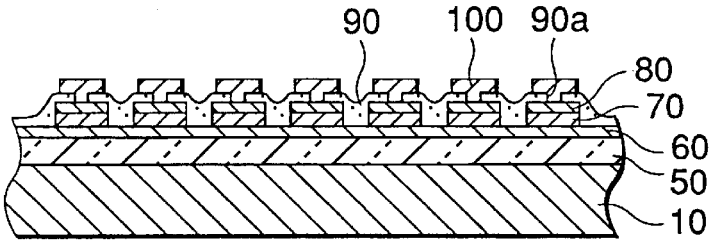

Then, as shown in FIG. 5B, the insulating layer 90 is patterned so that contact holes 90*a* are formed in the portions corresponding to portions adjacent to end portions of the ink supply portions of the pressure generating chambers 12. The contact holes 90*a* establish the connection between the conductive pattern 100 to be described later and the upper electrode film 80. Note that the contact holes 90*a* may be formed in the other portions of the pressure generating chambers 12, for example, in the central portion or end portions adjacent to the nozzles.

Then, a conductive member made of, for example, Cr—Au, is formed on the overall surface, and then patterned. Thus, the conductive pattern 100 is formed.

Figure 5C:
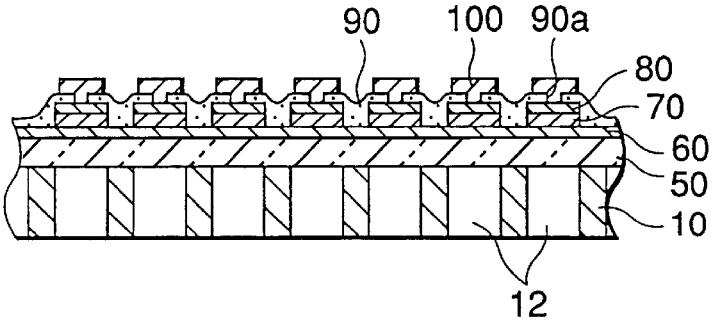

The process for forming the films is arranged as described above. After the films have been formed as described above, the single-crystal silicon substrate is anisotropically etched with the above-mentioned alkali solution so that the pressure generating chambers 12 and the like are formed, as shown in FIG. 5C. Note that the above-mentioned sequential film forming processes and the anisotropic etching process are performed such that a multiplicity of chips are simultaneously formed on one wafer. After the foregoing processes have been completed, the chips are sectioned for each of the fluid-passage-forming substrate 10 having the chip size as shown in FIG. 1. Then, the sectioned fluid-passage-forming substrate 10 is sequentially bonded to the sealing plate 20, the common-ink-chamber forming substrate 30 and the ink-chamber side plate 40 so as to be integrated. Thus, the ink jet printing head is manufactured.

The thus-constituted ink jet head receives ink through the ink introducing opening 42 connected to the external ink supply means (not shown). Thus, the inside portion from the common ink chamber 31 to the nozzle openings 11 is filled with ink. In response to a record signal supplied from an external drive circuit (not shown), voltage is applied to a portion between the lower electrode film 60 and the upper electrode film 80 through the conductive pattern 100. Thus, the elastic film 50, the lower electrode film 60 and the piezoelectric film 70 are deflected and deformed so that the pressure in the pressure generating chambers 12 is raised. As a result, ink droplets eject through the nozzle openings 11.

Figure 6:
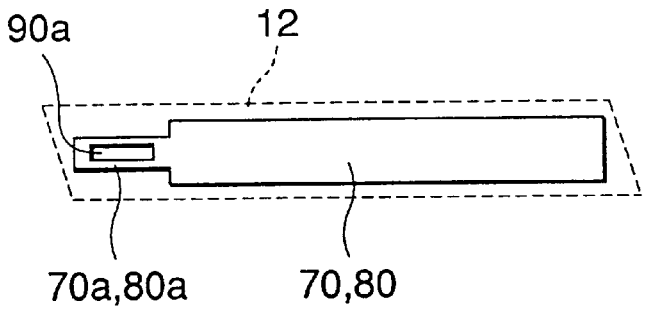
FIG. 6 is a plan view showing an essential portion of the first embodiment of the present invention.

The shape of the piezoelectric actuator and the pressure generating chamber 12 are shown in FIG. 6.

As shown in FIG. 6, this embodiment has the structure that the portions of the piezoelectric film 70 and the upper electrode film 80 in which the contact holes 90*a* are formed are made to be small-width portions 70*a* and small-width portions 80*a* each having a small width as compared with the other portions. The other portions are patterned to substantially correspond to the shapes of the pressure generating chambers 12. The contact holes 90*a* of the insulating layer 90 are formed in the small-width portions 80*a*. In the contact holes 90*a,* a portion which is connected to the conductive pattern 100 is formed.

As described above, this embodiment has the structure that the width of each of the piezoelectric elements in the portions of the contact hole 90*a* for forming the connection portion with the conductive pattern 100 is reduced. Therefore, the amounts of deflection of the portions corresponding to the contact holes 90*a* can be reduced. Thus, stress which is imposed to the small-width portion 70*a* and the small-width portion 80*a* can be reduced. As a result, cracks and breakage can be prevented. The present embodiment may also be realized by making the active part of the piezoelectric element at the contact hole 90*a* small in width.

2. Second Embodiment

Figure 7:
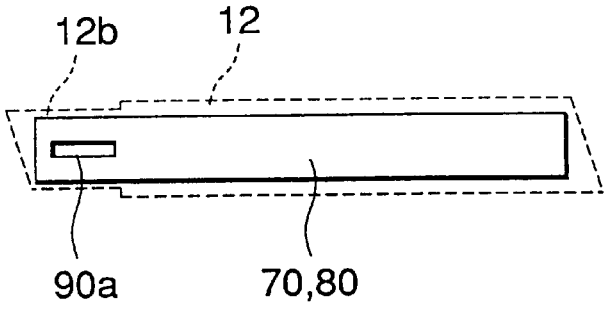
FIG. 7 is a plan view showing an essential portion of a second embodiment of the present invention.

FIG. 7 shows shapes of a piezoelectric actuator and a pressure generating chamber of an ink jet printing head according to a second embodiment of the present invention.

In place of the small-width portion 70*a* of the piezoelectric film 70 and the small-width portion 80*a* of the upper electrode film 80 according to the first embodiment, this embodiment has a structure that a small-width portion 12*b* is formed in a portion of the pressure generating chamber 12 corresponding to the contact hole 90*a*. The other portions are formed similarly to those according to the first embodiment That is, the small-width portion 12b is formed in a portion of the pressure generating chamber 12. Moreover, the piezoelectric film 70 and the upper electrode film 80 are formed to have the same width in the overall portion of the pressure generating chambers 12. In addition, the contact holes 90*a* of the insulating layer 90 are formed in the portions corresponding to the small-width portions 12*b*.

Therefore, when voltage is applied to the piezoelectric actuator through the contact hole 90*a*, displacement of a portion corresponding to the small-width portion 12*b* of the pressure generating chambers 12, that is, the portion connected to the conductive pattern 100 through the contact hole 90*a* is restrained. As a result, stress which is imposed to the portions of the piezoelectric film 70 and the upper electrode film 80 corresponding to the contact hole 90*a* is reduced. Thus, cracks and breakage can be prevented. Moreover, compliance of the portions corresponding to the contact holes 90*a* can be reduced and therefore the eject speed can be raised.

3. Third Embodiment

Figure 8:
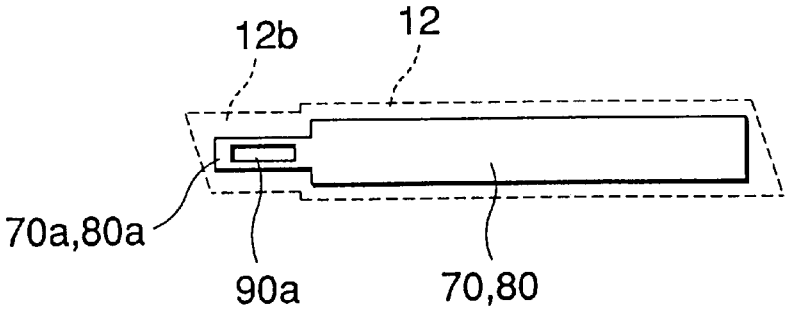
FIG. 8 is a plan view showing an essential portion of a third embodiment of the present invention.

FIG. 8 shows the shapes of a piezoelectric actuator and a pressure generating chamber of an ink jet printing head according to a third embodiment of the present invention.

This embodiment is constituted by combining the first embodiment and the second embodiment with each other. A small-width portion 12*b* is formed in a portion of the pressure generating chamber 12 corresponding to the contact hole 90*a*. Moreover, small-width portions 70*a* and 80*a* are provided for the piezoelectric film 70 and the upper electrode film 80. The other portions are formed similarly to those according to the first and second embodiments.

That is, a small-width portion 12*b* is formed adjacent to an end of the ink supply portion of the pressure generating chambers 12. Moreover, the width of the portions of the piezoelectric film 70 and the upper electrode film 80 corresponding to the small-width portion 12*b* is made to be smaller than the widths of the other portions. Thus, a small-width portion 70*a* and a small-width portion 80*a* are formed. Moreover, a contact hole 90*a* of an insulating layer 90 is formed in a portion corresponding to the small-width portion 12*b*.

Therefore, when voltage is applied to the piezoelectric actuator through the contact hole 90*a*, the displacement of the portion of the pressure generating chamber 12 corresponding to the small-width portion 12*b*, that is, the connection portion with the conductive pattern 100 through the contact hole 90*a* is furthermore reduced. As a result, stress imposed to the portions of the piezoelectric film 70 and the upper electrode film 80 corresponding to the contact hole 90*a* is reduced. As a result, compliance of the portion corresponding to the contact hole 90*a* is reduced. In consequence, the eject speed is raised.

4. Fourth Embodiment

Figure 9A:
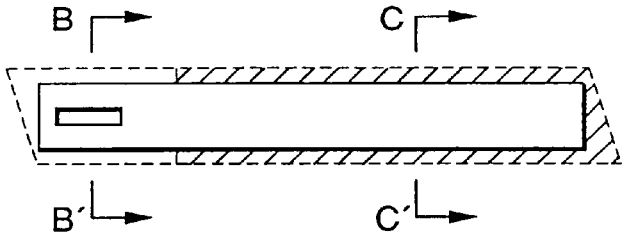
FIGS. 9A, 9B and 9C are a plan view and cross sectional views showing an essential portion of a fourth embodiment of the present invention.
Figure 9B:
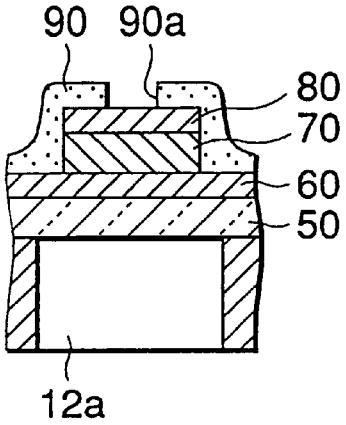
Figure 9C:
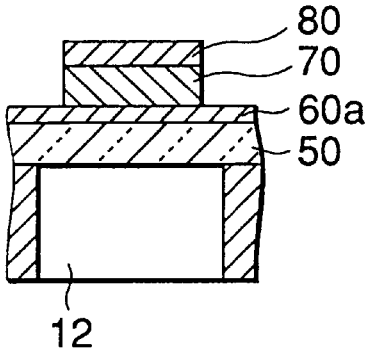

FIGS. 9A–9C show the shape of a piezoelectric actuator and a pressure generating chamber 12 of an ink jet printing head according to a fourth embodiment of the present invention.

This embodiment has a structure that the thickness of an elastic film 50 and a lower electrode film 60 serving as the oscillating plate of the piezoelectric vibrator is made to be different between portions corresponding to the contact holes 90*a* and the other portions not corresponding to the contact holes. Thus, the portions corresponding to the contact holes 90*a* cannot easily be deformed.

That is, the thickness of the portions of the lower electrode film 60 opposite to the pressure generating chambers 12 except for the portions corresponding to the contact holes 90*a* (portions shown with diagonal lines shown in FIG. 9A) is reduced. Thus, a thin portion 60*a* is formed, and a piezoelectric film 70 and an upper electrode film 80 are formed on the thin portion 60*a*. The thin portion 60*a* of the lower electrode film 60 can easily be formed by ion milling or the like.

Therefore, when voltage is applied to the piezoelectric actuator, the portions except for the portion corresponding to the contact hole 90*a* can easily be deformed. Conversely, deformation of the portion corresponding to the contact hole 90*a* is relatively restrained. Therefore, generation of stress is prevented. As a result, cracks and breakage can be prevented. In this embodiment, the insulating layer 90 in the portions except for the contact hole 90*a* is removed to enlarge the amount of deformation.

Figure 10:
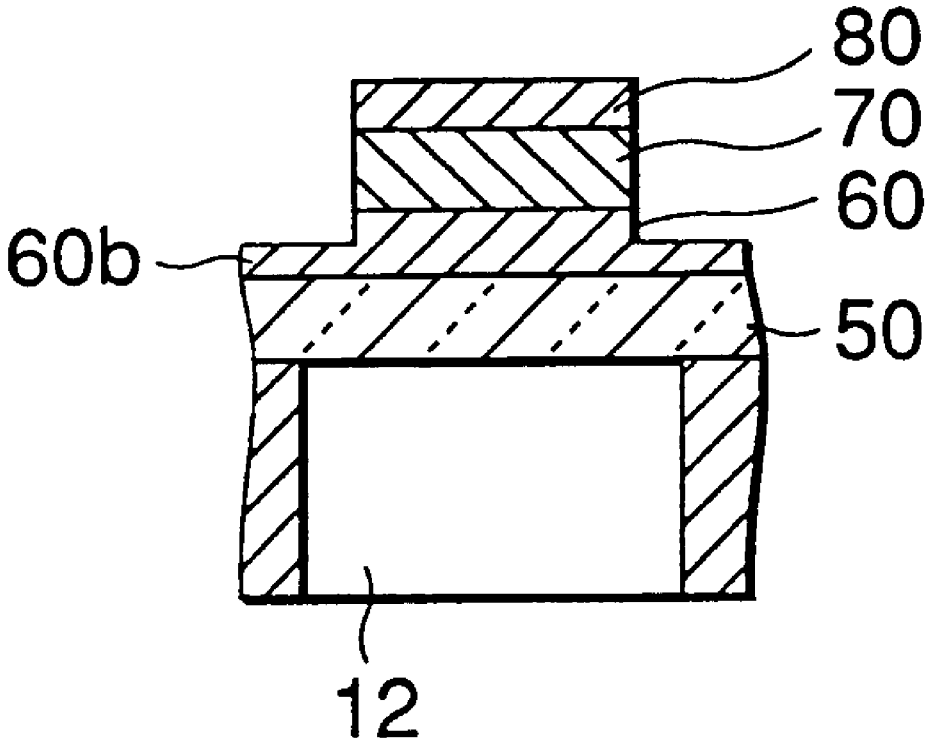
FIG. 10 is a cross sectional view showing an essential portion of a modification of the fourth embodiment of the present invention.

Although this embodiment has the structure that the thickness of the lower electrode film 60 in the portions except for the portion opposite to the pressure generating chamber 12 and corresponding to the contact hole 90*a* is reduced. To realize the structure in which the thickness of the oscillation plate is reduced so that the oscillation plate is easily reduced, a thin portion 60*b* may be provided for only the portion corresponding to the peripheral portion of the pressure generating chamber 12, as shown in FIG. 10. Also in this case, the insulating layer 90 in the portions except for the contact hole 90*a* is removed to enlarge the amount of deformation.

In either case, the thickness of the portion adjacent to the peripheral portion, which is the most important portion for the deformation realized by the piezoelectric vibrator is required to be reduced. Therefore, it is preferable that the thickness of a portion from the peripheral portion of the pressure generating chamber 12 to a position somewhat outer than the peripheral portion is reduced. The connection with the thin portion 60*b* of the adjacent pressure generating chamber 12 is permitted.

The thin portion may be provided for the elastic film 50 or both of the elastic film 50 and the lower electrode film 60 in place of the lower electrode film 60. As a matter of course, only the lower electrode may be provided as the elastic plate to provide the thin portion for the lower electrode.

5. Fifth Embodiment

Figure 13:
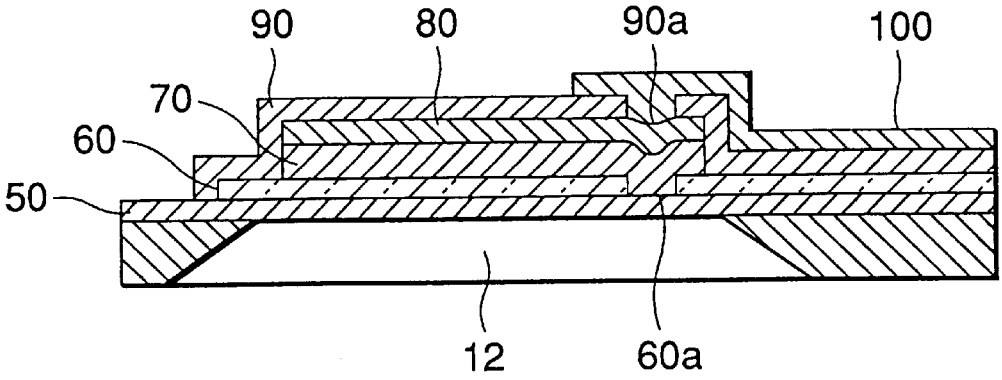
FIG. 13 is a sectional view showing an ink jet printing head according to a fifth embodiment of the invention.

FIG. 13 is a sectional view showing an ink jet printing head according to a fifth embodiment of the invention. According to the fifth embodiment, a portion corresponding to the contact hole 90*a* is constituted by a non-active piezoelectric element so that the portion corresponding to the contact hole 90*a* is relatively hardly deformed. More specifically, at least a part of the lower electrode a film 60 corresponding to the contact hole 90*a* is removed to form a lower electrode removed portion 60*a* which serves as a non-active piezoelectric element which would not cause piezoelectric deformation even if voltage is applied. According to the fifth embodiment, because the portion corresponding to the contact hole 90*a* is not piezoelectrically deformed by voltage applied thereto, it can be realized that the portion corresponding to the contact hole 90*a* is relatively hardly deformed.

Figure 14A:
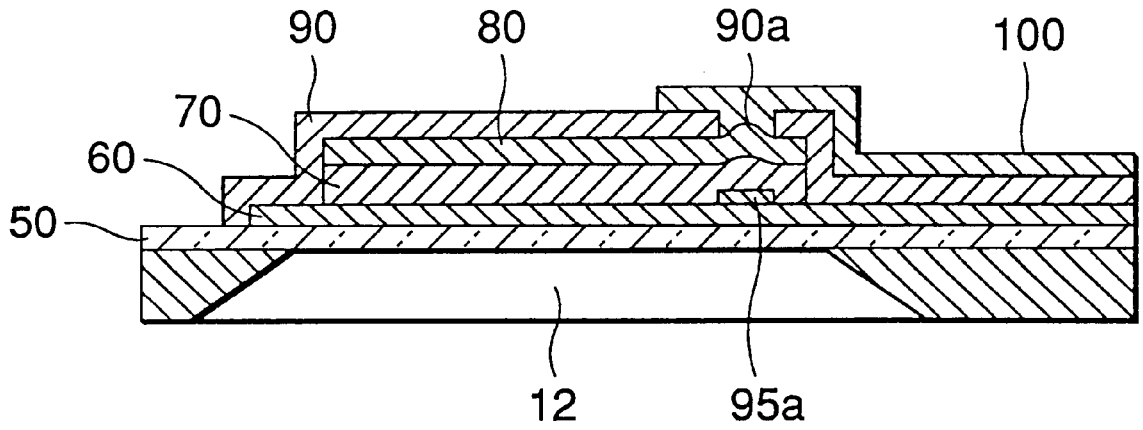
FIGS. 14A and 14B are sectional views showing an ink jet printing head according to another arrangement of the fifth embodiment shown in FIG. 13.
Figure 14B:
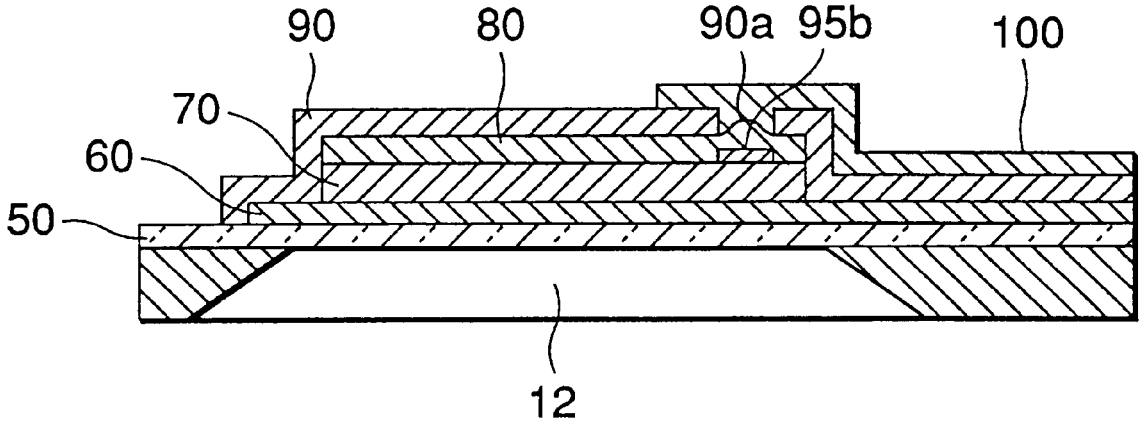

On the other hand, as another example of forming the non-active piezoelectric element so that the portion corresponding to the contact hole 90*a* is relatively hardly deformed, a low dielectric layer may be provided at a portion corresponding to the contact hole 90*a* as shown in FIGS. 14A and 14B. Specifically, as shown in FIG. 14A, a low dielectric layer 95*a* is formed between the lower electrode film 60 corresponding to the contact hole 90*a* and the piezoelectric film 70 so that the insulating layer forming region performs as a non-active piezoelectric portion. Further, as shown in FIG. 14B, a low dielectric layer 95*b* is formed between the piezoelectric film 70 corresponding to the contact hole 90*a* and the upper electrode film 90 so that the low dielectric layer forming region serves as a non-active piezoelectric portion. As a result, it is realized that the portion corresponding to the contact hole 90*a* is not relatively hardly deformed.

In the both arrangement shown in FIGS. 14A and 14B, the low dielectric layer may preferably be formed from a material similar to the material of the insulating layer 90 shown in FIG. 2B having a thickness enough not to cause the piezoelectric phenomenon 6. Other Embodiments The embodiments of the present invention have been described. The basic structure of the ink jet printing head is not limited to the above-mentioned structures.

For example, other than the sealing plate 20 described above, the common-ink-chamber forming substrate 30 may be formed of glass ceramics. In addition, the thin wall 41 may be formed of glass ceramics as a separate member. The material, structure and the like may be modified if appropriate.

Although the above-mentioned embodiments have the structure that the nozzle openings are provided for the end surface of the fluid-passage-forming substrate 10, the nozzle openings projecting perpendicular to the surface may be formed.

Figure 11:
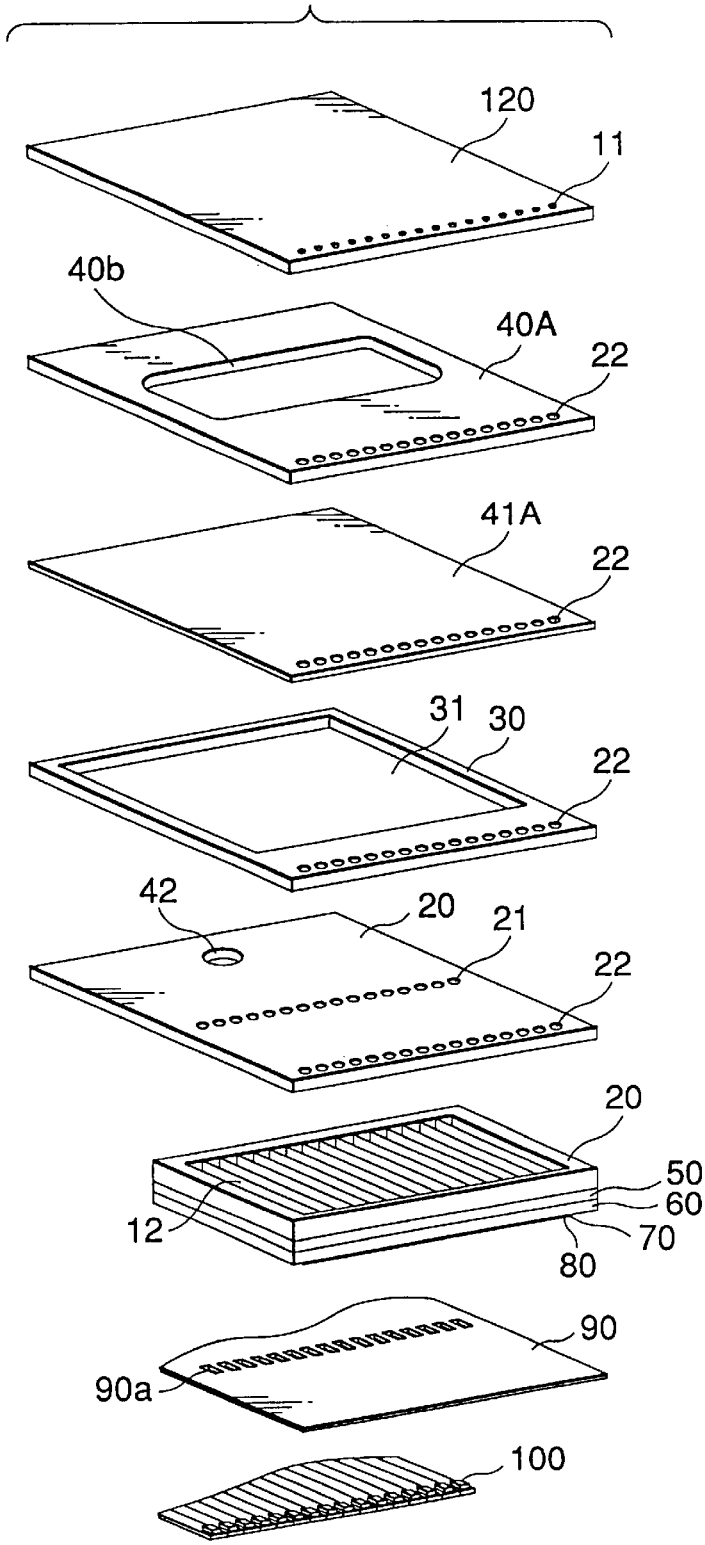
FIG. 11 is an exploded perspective view showing an ink jet printing head according to a fifth embodiment of the present invention.
Figure 12:
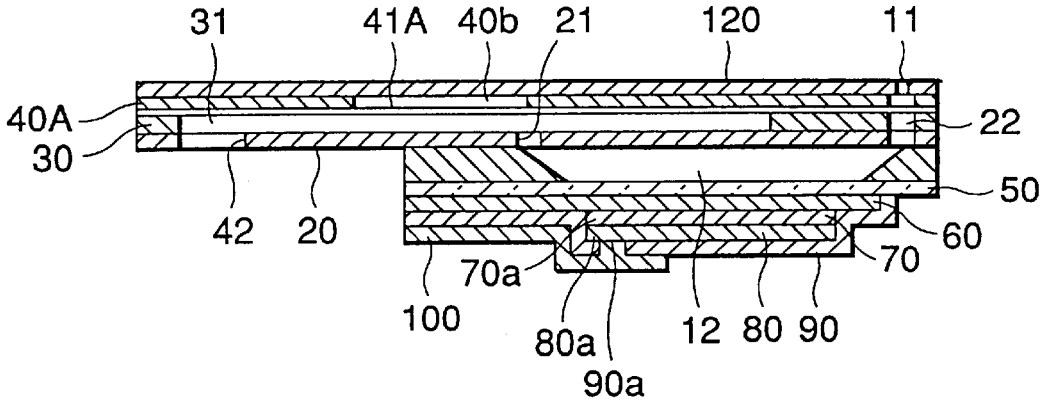
FIG. 12 is a cross sectional view showing an ink jet printing head according to the fifth embodiment of the present invention.

An exploded perspective view of the above-mentioned structure is shown in FIG. 11 and the cross sectional shape of the fluid passage is shown in FIG. 12. In this embodiment, the nozzle openings 11 are formed in a nozzle substrate 120 opposite to the piezoelectric vibrator. The nozzle communication openings 22 for establishing the communication between the nozzle openings 11 and the pressure generating chambers 12 are formed to penetrate the sealing plate 20, the common-ink-chamber forming substrate 30, the thin plate 41A and the ink-chamber side plate 40A.

This embodiment has a structure basically similar to the above-mentioned embodiments except for the structure that the thin plate 41A and the ink-chamber side plate 40A are made of individual elements and openings 40*b* are formed in the ink-chamber side plate 40. The same elements are given the same reference numerals and the same elements are omitted from description.

Also in this embodiment, the small-width portion 70*a* and the small-width portion 80*a* are provided for the portions of the piezoelectric film 70 and the upper electrode film 80 corresponding to the contact holes 90*a* of the insulating layer 90, similarly to the first embodiment. As a result, the portions corresponding to the contact holes 90*a* cannot easily be deformed as compared with the other portions. Thus, an effect similar to that obtainable from the first embodiment can be obtained. As a matter of course, the structures according to the second to fourth embodiments may be applied.

Each of the above-mentioned embodiments has been described about the thin-type ink jet printing head which can be manufactured by performing the film forming process and the lithography process. As a matter of course, the present invention is not limited to the above-mentioned structures. For example, the present invention can be applied to a variety of ink jet printing heads including a structure in which the pressure generating chambers are formed by laminating substrates, a structure in which the piezoelectric film is formed by applying a green sheet or by performing a screen printing or a structure in which the piezoelectric film is formed by using growth of crystal.

Although each embodiment has the structure that the elastic film is provided as the elastic plate individually from the lower electrode, the lower electrode may also serve as the elastic film.

Although the structure in which the insulating layer is a formed between the piezoelectric actuator and the lead electrode has been described, the present invention is not limited to the foregoing structure. For example, the insulating layer may be omitted and an anisotropic conductive film may be thermally welded to each of the upper electrode. Moreover, the anisotropic conductive film may be connected to the lead electrode. As an alternative to this, the connection may be established by any one of various bonding technologies, such as wire bonding.

As described above, the present invention may be applied to a variety of ink jet printing heads within the scope of the present invention.

As described above, according to the present invention, the portions of the elastic plate opposite to the pressure generating chambers corresponding to the contact holes cannot easily be deformed by dint of voltage applied to the piezoelectric element as compared with the other portions. Therefore, an effect can be obtained in that cracks and breakage caused from the operation can be prevented.

What is claimed is:

1. An ink jet printing head comprising:

a pressure generating chamber;

nozzle openings formed in said pressure generating chamber;

a piezoelectric actuator comprising:

an elastic plate formed adjacent to at least a portion of said pressure generating chamber;

a piezoelectric activating portion comprising a lower electrode film, a piezoelectric layer and an upper electrode film formed in a region opposite to said pressure generating chamber;

a conductive pattern connected to said upper electrode film, wherein a contact portion formed opposite to said pressure generating chamber connecting to said conductive pattern for applying voltage to the upper electrode of said piezoelectric activating portion is formed on the upper surface of said upper electrode; and vibration-regulating means for partially regulating vibration of said piezoelectric actuator formed in a region where said contact portion is formed;

whereby deformation of a portion of said elastic plate, which is opposite to said pressure generating chamber, corresponding to said contact portion is reduced when voltage is applied to said piezoelectric actuator.

2. An ink jet printing head according to claim 1, wherein an insulating layer is formed on the upper surface of said upper electrode, and said insulating layer has a contact hole portion which is a window for forming said contact portion between said lead electrode and said upper electrode.

3. An ink jet printing head according to claim 1, wherein the width the piezoelectric activating portion, which corresponds to said pressure generating chamber, corresponding to said contact portion is smaller than the width of other portions of said piezoelectric activating portion.

4. An ink jet printing head according to claim 1, wherein the width of a portion of said pressure generating chamber, corresponding to said contact portion is smaller than the width of other portions of said pressure generating chamber in a width direction of said pressure generating chamber.

5. An ink jet printing head according to claim 1, wherein the thickness of said elastic plate, which covers said pressure generating chamber, corresponding to said contact portion is larger than the thickness of other portions of said elastic plate.

6. An ink jet printing head according to claim 1, wherein the thickness of the portion of said elastic plate, which covers said pressure generating chamber, adjacent to an outer wall of either of said pressure generating chambers is larger in a portion corresponding to the contact hole portion than in the portions other than a portion corresponding to said contact hole portion.

7. An ink jet printing head according to claim 1, wherein said pressure generating chamber is formed on a single-crystal silicon substrate by anisotropic etching, and each layer of said piezoelectric vibrator is formed by a film forming process and a lithography process.

8. An ink jet printing head according to claim 1, wherein a portion of said piezoelectric activating portion located near said contact portion is a non-active piezoelectric portion.

9. An ink jet printing head according to claim 8, wherein the non-active piezoelectric portion is formed by removing the lower electrode film corresponding to the contact portion.

10. An ink jet printing head according to claim 8, wherein the non-active piezoelectric portion is formed by disposing a dielectric layer between the piezoelectric element corresponding to the contact portion and the lower electrode film.

11. An ink jet printing head according to claim 8, wherein the non-active piezoelectric portion is formed by disposing a dielectric layer between the piezoelectric element corresponding to the contact portion and the upper electrode film.

12. An ink jet printing head according to claim 1, said lower electrode film having a thickness, wherein said thickness of said lower electrode film is reduced at a portion opposite to said pressure generating chamber.

* * * * *